US007834737B2

(12) United States Patent
Wolf et al.

(10) Patent No.: US 7,834,737 B2
(45) Date of Patent: Nov. 16, 2010

(54) IGNITION APPARATUS HAVING BONDED STEEL WIRE CENTRAL CORE

(75) Inventors: Edgard Wolf, Chihuahua (MX); Albert A. Skinner, El Paso, TX (US); Colin J. Hamer, El Paso, TX (US); Mark L. Whittemore, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 105 days.

(21) Appl. No.: 11/852,592

(22) Filed: Sep. 10, 2007

(65) Prior Publication Data

US 2009/0066464 A1 Mar. 12, 2009

(51) Int. Cl.
*H01F 27/24* (2006.01)

(52) U.S. Cl. ..... 336/234

(58) Field of Classification Search ..... 336/65, 336/83, 174–175, 233–234, 212; 123/634–635
See application file for complete search history.

(56) References Cited

U.S. PATENT DOCUMENTS 416,189 A * 12/1889 Stone ..... 57/211
1,497,469 A * 6/1924 Ames ..... 336/192
1,641,374 A * 9/1927 Chryst ..... 336/92
4,035,751 A * 7/1977 Walthew ..... 336/60
4,480,377 A 11/1984 House et al.
5,015,982 A 5/1991 Skinner et al.
5,034,737 A * 7/1991 Harvey et al. ..... 340/815.86
5,268,663 A * 12/1993 Takeuti et al. ..... 336/212
6,758,993 B2 * 7/2004 Berk et al. ..... 264/40.6
6,834,644 B1 12/2004 Skinner et al.
2008/0141987 A1 * 6/2008 Skinner et al. ..... 123/634

FOREIGN PATENT DOCUMENTS

FR 2784496 A1 * 4/2000
JP 09022826 A * 1/1997

* cited by examiner

*Primary Examiner*—Tuyen Nguyen
(74) *Attorney, Agent, or Firm*—Thomas N. Twomey

(57) ABSTRACT

An ignition apparatus includes a transformer having a central core, a primary winding disposed thereabout, a secondary winding disposed outwardly of the primary winding, a case configured to house the central components, and an outer core or shield disposed outwardly of the secondary winding. The central core is formed from multiple, low carbon steel wires held together is a cylindrical shape with cured bond coating material such as an epoxy material or an aromatic polyamide material. In one configuration, at least two different sizes of wires are used in forming the core to increase the density of the magnetically-permeable wire material in the core.

9 Claims, 3 Drawing Sheets

IGNITION APPARATUS HAVING BONDED STEEL WIRE CENTRAL CORE

BACKGROUND OF THE INVENTION

1. Related Field

The present invention relates generally to ignition coils, and more particularly, to an ignition coil for a spark ignition internal combustion engine having a bonded steel wire central core.

2. Description of the Related Art

Ignition coils utilize primary and secondary windings and a magnetic circuit. The magnetic circuit may include a central core formed of magnetically permeable material and a side core or shield, also of magnetically permeable material. In regard to the central core, a variety of different configurations and materials have been utilized.

For example, for cylindrical central cores, it is known to use steel laminations of varying widths arranged to form a circular cross section, unbound, individual strands of wires, composite iron material (i.e., plastic coated powdered iron particles) as well as soft ferrites. However, there remains a need for improving performance and/or reducing cost for a central core.

SUMMARY OF THE INVENTION

One advantage of the present invention is that provides a central core for an ignition apparatus that uses common materials and that can be made using common processes. These two aspects combine to yield a reduced cost component.

An ignition apparatus for a spark ignited internal combustion engine includes a cylindrical central core, primary and secondary windings outwardly of the central core, a housing for the central core and windings, and an outer core. The central core has a longitudinal axis, and is formed with a plurality of low carbon steel wires each having a respective wire axis that is substantially parallel to the longitudinal axis. The wires are held together to form the core by an outer bond coating.

In one embodiment, wires of 2 or more different diameters are used to form a cylindrical core that has an increased fill percentage.

A method for forming the core is also presented.

BRIEF DESCRIPTION OF THE DRAWINGS

The present invention will now be described, by way of example, with reference to the accompanying drawings, wherein like reference numerals identify identical components in the several figures, in which.

DETAILED DESCRIPTION OF THE PREFERRED EMBODIMENTS

Figure 1:
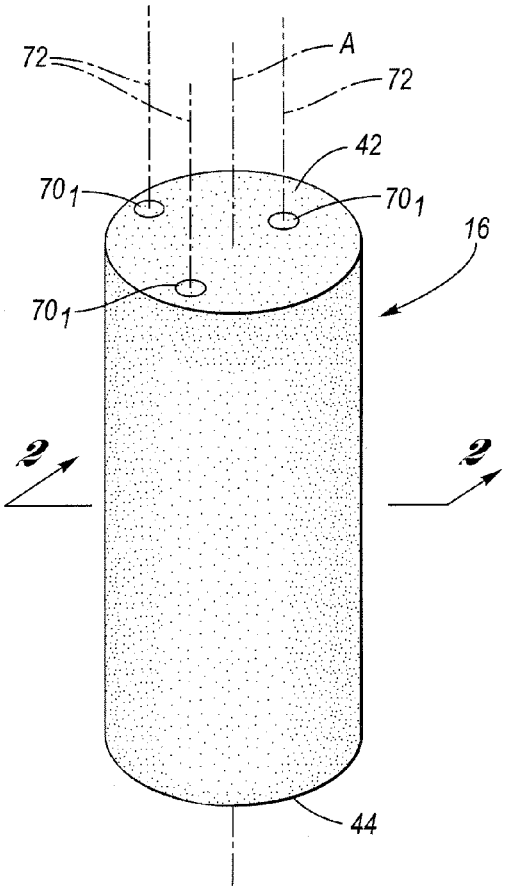
FIG. 1 is a simplified diagrammatic view of a central core for an ignition apparatus formed from bonded steel wire.

Referring now to the drawings wherein like reference numerals are used to identify identical components in the various views, FIG. 1 is a perspective, diagrammatic view of a cylindrical central core 16 configured for use in an ignition apparatus. Core 16 may be elongated, having a main, longitudinal axis "A" associated therewith. Core 16 includes an upper, first end 42, and a lower, axially opposite second end 44. As illustrated, core 16, in the preferred embodiment, takes a generally cylindrical shape (which is a generally circular shape in radial cross-section), and is comprised of a plurality of low carbon steel wires, three exemplary wires being shown in FIG. 1 and each designated $\mathbf{70}_1$. Each wire $\mathbf{70}_1$ extends along a respective wire axis 72, which wire axes 72 are substantially parallel to main axis "A" of core 16. In a preferred embodiment, low carbon steel wires are used to form core 16, which comprise suitable magnetically-permeable material. Low carbon steel wire may comprise steel material containing no more than about 0.30% by weight of carbon. Commercially available material suitable for embodiments of the present invention include steel wire conforming to American Iron and Steel Institute (AISI) designations 1020 (Elemental composition, by weight: C: 0.18-0.23% max.; Mn: 0.30 to 0.60%; P: 0.04% max.; S: 0.05% max.), 1015 (Elemental composition, by weight: C: 0.13-0.18% max.; Mn: 0.30 to 0.60%; P: 0.04% max.; S: 0.05% max.), 1008 (Elemental composition, by weight: C: 0.10% max.; Mn: 0.30 to 0.50%; P: 0.04% max.; S: 0.05% max.) and 1005 (Elemental composition, by weight: C: 0.06% max.; Mn 0.35% max.; P 0.04% max.; S 0.05% max.). Steel wire conforming to AISI 1008, may be preferred for its magnetic flux carrying properties. Steel wire conforming to AISI 1015 may be preferred as being of a reduced cost as it corresponds to widely available fencing wire.

Figure 2:
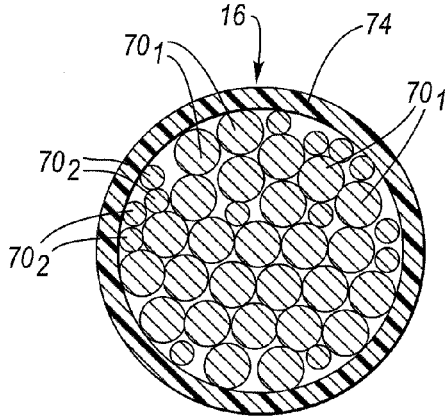
FIG. 2 is a cross sectional view of the central core taken substantially along lines 2-2 in FIG. 1.

FIG. 2 is a cross-sectional view of core 16 taken substantially along lines 2-2 in FIG. 1. In order to improve the density of the magnetically permeable material in core 16 (i.e., the percent of fill), steel wires of two or more diameters may be used. As shown, steel wires $\mathbf{70}_1$ have a first diameter, while steel wires designated $\mathbf{70}_2$ have a second diameter that is different from and less than the first diameter. It should be understood that wires having still different diameters from the first and second diameters may be used in order to further increase the percentage of fill. In one embodiment, the first diameter may be about 1 mm, while the second, reduced diameter may be between about 0.33 and 0.50 mm.

The plurality of steel wires $\mathbf{70}_i$, where i is equal to 1, 2, . . . , n equal to the number of different diameters used in core 16, define a bundle that is preferably held together by a radially outermost bond coat 74. Bond coat materials suitable for use with magnet wire (i.e., the steel wires $\mathbf{70}_1$ and $\mathbf{70}_2$) are known in the art, and may be one selected from the group comprising either epoxy material (stage B), or aromatic polyamide material. Desired performance characteristics of the bond coat 74 include the ability to withstand temperatures up to and around 180° C. during the service life of an ignition apparatus 10 that includes the inventive bonded steel wire core 16. Commercially available sources include Henkel Corporation (formerly Henkel Loctite), Auburn Hills, Mich. and Superior Essex, Inc. of Atlanta, Ga.

It is contemplated that the thickness of bond coat 74 will be the minimum required to hold the bundle together while undergoing subsequent manufacturing procedures (e.g., winding the primary winding on the outer surface of bond coat 74). Moreover, it should be understood that bond coat 74 need not extend into and occupy any of any of the interstitial voids between the various steel wires. The primary function of bond coat 74 is mechanical in nature, holding the steel wires together sufficiently so as to withstand further manufacturing procedures (e.g., winding the primary winding on the outermost surface of coat 74). Moreover, the bond coat 74 may also serve an electrical insulation function.

Figure 3:
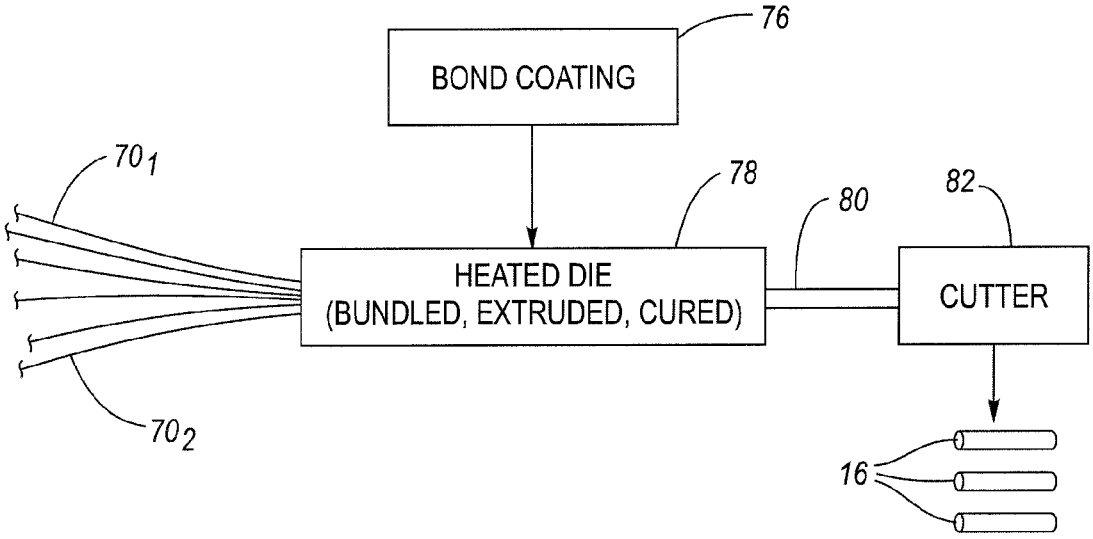
FIG. 3 is a diagrammatic view of a first embodiment of a method of making a bonded steel wire central core.

FIG. 3 is a diagrammatic view of a first embodiment of a method of making a bonded steel wire central core 16. The first step involves providing individual steel wires, such as steel wires $\mathbf{70}_1$ and $\mathbf{70}_2$, to a heated die 78, where the steel wires are mechanically bundled together into a desired, predetermined shape/configuration. The next step involves applying bond coat material from a source 76 of bond coating material. The next steps involve extruding the bundle through the die, at preselected temperature profiles and times, to cure the bond coating material to form bond coat 74 and thus hold the individual wires together. The movement speed of the coated bundle through the die and the selected temperature (or temperature regions within die 78, or temperature profiles over time) may be determined as a function of the particular bond coating material and the selected final thickness of the bond coat 74, among other factors that would be understood by one of ordinary skill in the art. Additionally, in a further embodiment, die 78 may be configured to compress the bundle of steel wires by a predetermined amount. The next step involves transferring the continuous bonded steel wire core 80 to a cutter mechanism 82. Finally, the cutter mechanism 82 is configured to cut continuous core 80 into a desired longitudinal length to obtain a plurality of individual cores 16.

Figure 4:
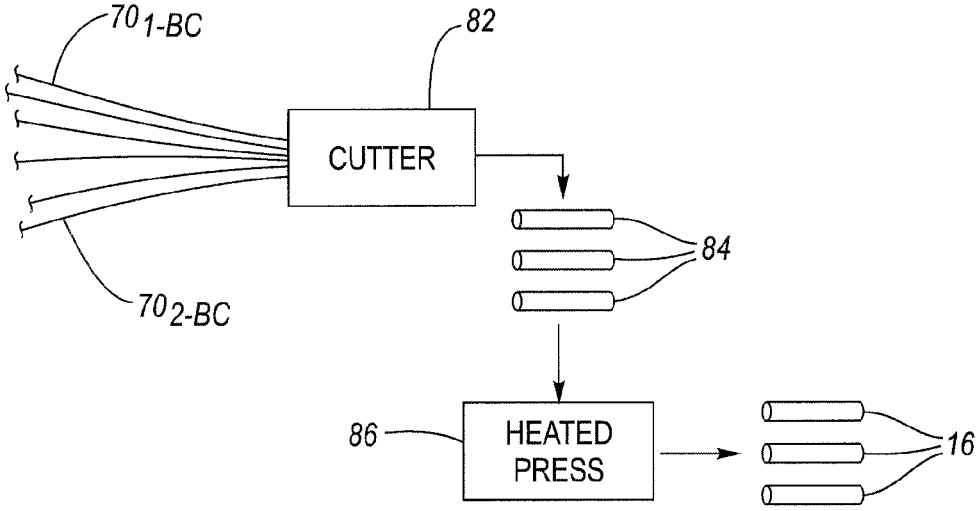
FIG. 4 is a diagrammatic view of a second embodiment of a method of making a bonded steel wire central core.

FIG. 4 is a diagrammatic view of a second, alternative embodiment of a method of making a bonded steel wire central core 16. The first step involves providing individual bond coated steel wires, designated $\mathbf{70}_{1\text{-}BC}$ and $\mathbf{70}_{2\text{-}BC}$ in FIG. 4, to a cutter mechanism 82. The cutter mechanism is configured to cut the individual bond coated wires so that after cutting the free portion of the steel wires have a predetermined length—the longitudinal length desired for core 16 in one embodiment. The next step involves transferring the cut-to-length but as-yet uncured bundles of steel wires 84 to a heated press 86. The final step involves heating each bundle 84 to cure the bond coating material and thus form the bonded steel wire central core 16.

Figure 5:
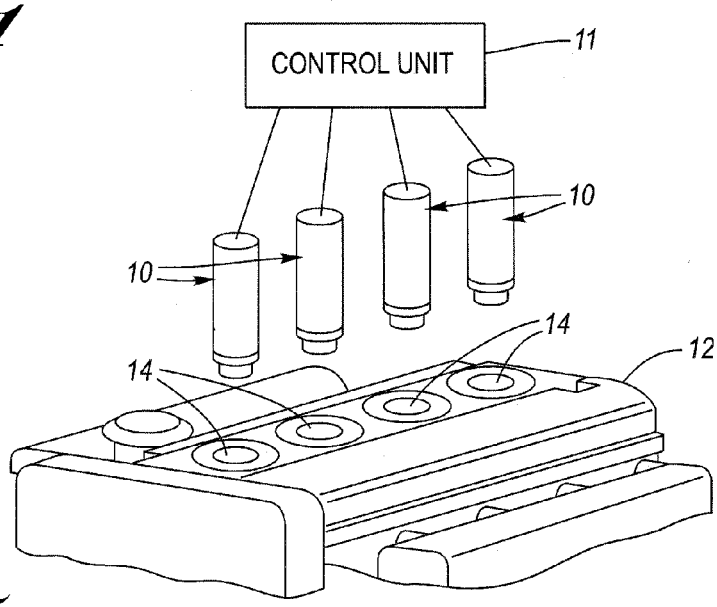
FIG. 5 is a plan view showing a preferred environment in which an ignition apparatus using the present invention may be deployed.

FIG. 5 shows an environment in which an ignition apparatus 10, having the bonded steel wire central core 16, and controlled by a control unit 11 or the like, may be employed. Apparatus 10 may be adapted for installation to a conventional spark ignited internal combustion engine 12 by way of a spark plug 13 in threaded engagement with a spark plug opening 14 into a combustion cylinder. Generally, overall spark timing (dwell control) and the like is provided by control unit 11. One ignition apparatus including the inventive core 16 may be provided per spark plug.

Figure 6:
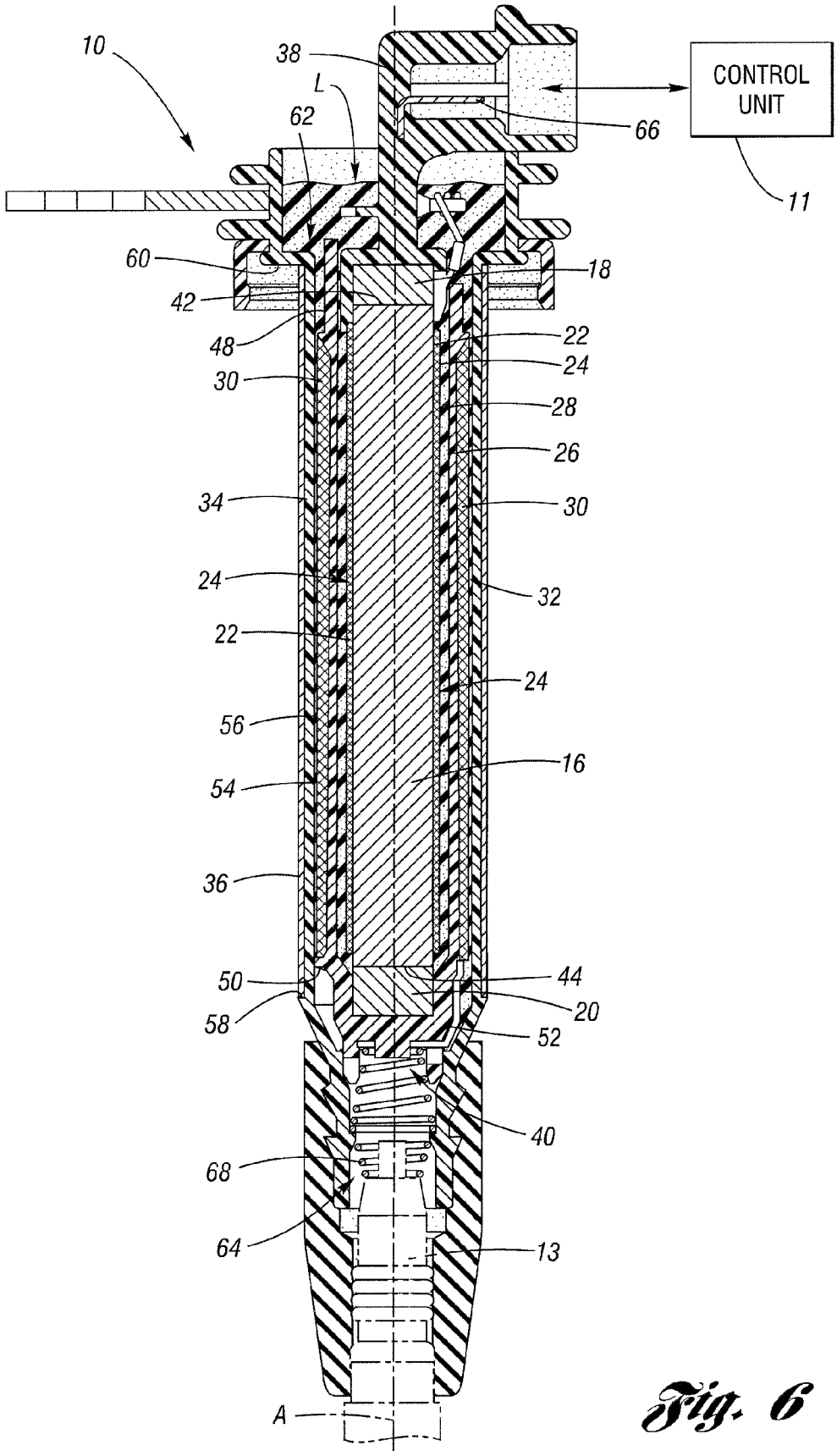
FIG. 6 is a cross-sectional view of an exemplary ignition apparatus in which the present invention may be embodied.

Referring now to FIG. 6, further details concerning an exemplary ignition apparatus 10 will now be set forth configured to use the inventive central core 16. It should be understood that the following is exemplary only and not limiting in nature. Many other configurations are known to those of ordinary skill in the art and are consistent with the teachings of the present invention. Apparatus 10 may include inventive core 16, optional first and second magnets 18, 20, a primary winding 24, a first layer of encapsulant such as an epoxy potting material layer 26, a secondary winding spool 28, a secondary winding 30, a second epoxy potting material layer 32, a case 34, shield 36, a low-voltage (LV) connector body 38, a high-voltage (HV) connector assembly 40.

Magnets 18 and 20 may be optionally included in ignition apparatus 10 as part of the magnetic circuit, and provide a magnetic bias for improved performance. The construction of magnets such as magnets 18 and 20, as well as their use and effect on performance, is well understood by those of ordinary skill in the art. It should be understood that magnets 18 and 20 are optional in ignition apparatus 10, and may be omitted, albeit with a reduced level of performance, which may be acceptable, depending on performance requirements.

Primary winding 24 may be wound directly onto core 16 in a manner known in the art. Primary winding 24 includes first and second ends and is configured to carry a primary current $I_P$ for charging apparatus 10 upon control of ignition system 11. Winding 24 may comprise magnet wire, with a thickness of between about 20-23 AWG. Winding 24 may be implemented using known approaches and conventional materials.

Layers 26 and 32 comprise an encapsulant suitable for providing electrical insulation within ignition apparatus 10. In a preferred embodiment, the encapsulant comprises epoxy potting material. The epoxy potting material introduced in layers 26, and 32 may be introduced into annular potting channels defined (i) between primary winding 24 and secondary winding spool 28, and, (ii) between secondary winding 30 and case 34. The potting channels are filled with potting material, in the illustrated embodiment, up to approximately the level designated "L". In one embodiment, layer 26 may be between about 0.1 mm and 1.0 mm thick. Of course, a variety of other thicknesses are possible depending on flow characteristics and insulating characteristics of the encapsulant. The potting material also provides protection from environmental factors which may be encountered during the service life of ignition apparatus 10. There is a number of suitable epoxy potting materials well known to those of ordinary skill in the art.

Secondary winding spool 28 is configured to receive and retain secondary winding 30. Spool 28 is disposed adjacent to and radially outwardly of the central components comprising core 16, primary winding 24, and epoxy potting layer 26, and, preferably, is in coaxial relationship therewith. Spool 28 may comprise any one of a number of conventional spool configurations known to those of ordinary skill in the art. In the illustrated embodiment, spool 28 is configured to receive one continuous secondary winding (e.g., progressive winding), as is known. However, it should be understood that other configurations may be employed, such as, for example only, a configuration adapted for use with a segmented winding strategy (e.g., a spool of the type having a plurality of axially spaced ribs forming a plurality of channels therebetween for accepting windings), as known.

The depth of the secondary winding in the illustrated embodiment may decrease from the top of spool 28 (i.e., near the upper end 42 of core 16), to the other end of spool 28 (i.e., near the lower end 44) by way of a progressive gradual flare of the spool body. The result of the flare or taper is to increase the radial distance (i.e., taken with respect to axis "A") between primary winding 24 and secondary winding 30, progressively, from the top to the bottom. As is known in the art, the voltage gradient in the axial direction, which increases toward the spark plug end (i.e., high voltage end) of the secondary winding, may require increased dielectric insulation between the secondary and primary windings, and, may be provided for by way of the progressively increased separation between the secondary and primary windings.

Spool 28 is formed generally of electrical insulating material having properties suitable for use in a relatively high temperature environment. For example, spool 28 may comprise plastic material such as PPO/PS (e.g., NORYL available from General Electric) or polybutylene terephthalate (PBT) thermoplastic polyester. It should be understood that there are a variety of alternative materials that may be used for spool 28 known to those of ordinary skill in the ignition art, the foregoing being exemplary only and not limiting in nature.

Spool 28 may further include a first annular feature 48 and a second annular feature 50 formed at axially opposite ends thereof. Features 48 and 50 may be configured so as to engage an inner surface of case 34 to locate, align, and center the spool 28 in the cavity of case 34.

In addition, the body portion of spool 28 tapers on a lower end thereof to a reduced diameter, generally cylindrical outer surface sized to provide an interference fit with respect to a corresponding through-aperture at the lower end of case 34. In addition, the spool body includes a blind bore or well at the spark plug end configured in size and shape to accommodate the size and shape of HV connector assembly 40. In connection with this function, spool 28 includes an electrically conductive (i.e., metal) high-voltage (HV) terminal 52 disposed therein configured to connect the HV end of secondary winding 30 to the HV connector assembly 40.

FIG. 6 also shows secondary winding 30 in cross-section. Secondary winding 30, as described above, is wound on spool 28, and includes a low voltage end and a high voltage end. The low voltage end may be connected to ground by way of a ground connection through LV connector body 38 in a manner known to those of ordinary skill in the art. The high voltage end is connected to HV terminal 52 in a manner described above. Winding 30 may be implemented using conventional approaches and material known to those of ordinary skill in the art.

Case 34 includes an inner, generally cylindrical surface 54, an outer surface 56, a first annular shoulder 58, a flange 60, an upper through-bore 62, and a lower through bore 64.

Inner surface 54 is configured in size to receive and retain the core 16/primary winding 24/spool 28/secondary winding 30 assembly. The inner surface 54 of case 34 may be slightly spaced from spool 28, particularly the annular spacing features 48, 50 thereof (as shown), or may engage the spacing features 48, 50.

Annular shoulder 58 and flange 60 are located near the lower, and upper ends of case 34, respectively. Shoulder 58 is formed in size and shape to engage and support a bottommost circumferential edge of shield 36. Likewise, flange 60 is configured in size and shape to engage and support an uppermost circumferential edge of shield 36.

Bore 62 is configured in size and shape to receive the combined assembly of core 16/primary winding 24/spool 28/secondary winding 30.

Bore 64 is defined by an inner surface thereof configured in size and shape (i.e., generally cylindrical) to provide an interference fit with an outer surface of spool body 28 (i.e., a lowermost portion thereof), as described above. When the lowermost body portion of spool 28 is inserted in bore 64, therefore, a seal is made.

Case 34 is formed of electrical insulating material, and may comprise conventional materials known to those of ordinary skill in the art (e.g., the PBT thermoplastic polyester material referred to above).

Shield 36 is generally annular in shape and is disposed radially outwardly of case 34, and, preferably, engages outer surface 56 of case 34. The shield 36 is preferably comprises magnetically-permeable material that is also electrically conductive material, and, more preferably metal, such as silicon steel or other adequate magnetic material. Shield 36 provides not only a protective barrier for ignition apparatus 10 generally, but, further, provides a magnetic path for the magnetic circuit portion of ignition apparatus 10. Shield 36 may nominally be about 0.50 mm thick, in one embodiment. Shield 36 may be grounded by way of an internal grounding strap, finger or the like (not shown) well know to those of ordinary skill in the art. Shield 36 may comprise multiple, individual sheets 36.

Low voltage connector body 38 is configured to, among other things, electrically connect the first and second ends of primary winding 24 to an energization source, such as, the energization circuitry included in ignition system 11. Connector body 38 is generally formed of electrical insulating material, but also includes a plurality of electrically conductive output terminals 66 (e.g., pins for ground, primary winding leads, etc.). Terminals 66 are coupled electrically, internally through connector body 38, in a manner known to those of ordinary skill in the art, and are thereafter connected to various parts of apparatus 10, also in a manner generally know to those of ordinary skill in the art.

HV connector assembly 40 may include a spring contact 68 or the like, which is electrically coupled to HV terminal 52 disposed in a blind bore portion formed in a lowermost end of spool 28. Contact spring 68 is configured to engage a high-voltage connector terminal of spark plug 13. This arrangement for coupling the high voltage developed by secondary winding 30 to plug 13 is exemplary only; a number of alternative connector arrangements, particularly spring-biased arrangements, are known in the art.

The present invention provides a central core 16 for an ignition apparatus 10 using low cost low-carbon steel wires formed in accordance with a common, low cost bond coating fabrication process.

It is to be understood that the above description is merely exemplary rather than limiting in nature, the invention being limited only by the appended claims. Various modifications and changes may be made thereto by one of ordinary skill in the art, which embody the principles of the invention and fall within the spirit and scope thereof.

The invention claimed is:

1. An ignition apparatus comprising:

a cylindrical central core having a longitudinal axis, said central core comprising a plurality of low carbon steel wires each being circular in cross-section and having a respective wire axis substantially parallel to said longitudinal axis, said wires being held together by a radially outermost bond coat, wherein a first plurality of said circular cross-section wires each have a first diameter and a second plurality of said circular cross-section wires each have a second diameter different than said first diameter, and wherein said first plurality of said circular cross-section wires and said second plurality of said circular cross-section wires are substantially the same length;

primary and secondary windings outwardly of said central core;

a case configured to house said central core and said primary and secondary windings; and a magnetically-permeable shield outwardly of said case.

2. The apparatus of claim 1 wherein said first diameter is about 1 mm and said second diameter is between about 0.33 and 0.50 mm.

3. The apparatus of claim 1 wherein said bond coat comprises one selected from the group comprising epoxy material and aromatic polyamide material.

4. The apparatus of claim 1 wherein said low carbon steel wire comprises steel with no more than about 0.30% by weight of carbon.

5. The apparatus of claim 4 wherein said low carbon steel wire comprises steel conforming to one selected from the group comprising AISI 1020, AISI 1015, AISI 1008 and AISI 1005 steel.

6. The apparatus of claim 5 wherein said low carbon steel wire conforms to AISI 1015 steel.

7. The apparatus of claim 3 wherein said bond coat does not occupy any interstitial voids between said wires.

8. The apparatus of claim 1 wherein said bond coat consists of one selected from the group comprising epoxy material and aromatic polyamide material.

9. The apparatus of claim 1 wherein said second diameter is between one-half to one-third of said first diameter.

* * * * *